US011619959B2

(12) United States Patent
Gurun et al.

(10) Patent No.: US 11,619,959 B2
(45) Date of Patent: Apr. 4, 2023

(54) LOW DROPOUT REGULATOR WITH FEEDFORWARD POWER SUPPLY NOISE REJECTION CIRCUIT

(71) Applicant: Apple Inc., Cupertino, CA (US)

(72) Inventors: Gokce Gurun, San Jose, CA (US); Sanjeev K. Maheshwari, Fremont, CA (US); Wenbo Liu, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 323 days.

(21) Appl. No.: 17/029,991

(22) Filed: Sep. 23, 2020

(65) Prior Publication Data

US 2022/0091622 A1 Mar. 24, 2022

(51) Int. Cl.
*G05F 1/575* (2006.01)

(52) U.S. Cl.
CPC ..... *G05F 1/575* (2013.01)

(58) Field of Classification Search
CPC ... G05F 1/10; G05F 1/46; G05F 1/467; G05F 1/56; G05F 1/561; G05F 1/575; G05F 3/26; G05F 3/262; G05F 3/242
See application file for complete search history.

(56) References Cited

U.S. PATENT DOCUMENTS

| | | | | |
|---|---|---|---|---|
| 8,786,266 | B2 | 7/2014 | Deval et al. | |
| 9,438,109 | B2 | 9/2016 | Moon et al. | |
| 9,921,593 | B2 | 3/2018 | Gorecki et al. | |
| 2008/0284394 | A1* | 11/2008 | Yin | G05F 1/575 327/537 |
| 2017/0255215 | A1 | 9/2017 | Shukla et al. | |
| 2018/0284829 | A1* | 10/2018 | Hussien | H02P 9/30 |
| 2021/0028747 | A1* | 1/2021 | Hu | H03F 3/45197 |
| 2021/0311513 | A1* | 10/2021 | Joshi | G05F 1/575 |
| 2021/0373588 | A1* | 12/2021 | Wang | G05F 1/59 |

* cited by examiner

*Primary Examiner* — Thienvu V Tran
*Assistant Examiner* — Shahzeb K Ahmad
(74) *Attorney, Agent, or Firm* — Kowert, Hood, Munyon, Rankin & Goetzel, P.C.; Dean M. Munyon

(57) ABSTRACT

A voltage regulator circuit included in a computer system may include a switch device coupled between an input power supply node and a regulated power supply node. The switch device may change a value of a supply current flowing from the input power supply node and the regulated power supply node to regulate a voltage level of the regulated power supply node. A noise cancelation current may be feed forward onto a control terminal of the switch device to cancel noise on the regulated power supply node resulting from noise present on the input power supply node.

17 Claims, 10 Drawing Sheets

LOW DROPOUT REGULATOR WITH FEEDFORWARD POWER SUPPLY NOISE REJECTION CIRCUIT

BACKGROUND

Technical Field

Embodiments described herein relate to integrated circuits, and more particularly, to techniques for generating regulated power supply voltages.

Description of the Related Art

Modern computer systems may include multiple circuit blocks designed to perform various functions. For example, such circuit blocks may include processors, processor cores configured to execute software or program instructions. Additionally, the circuit blocks may include memory circuits, mixed-signal or analog circuits, and the like.

In some computer systems, the circuit blocks may be designed to operate at different power supply voltage levels. Power management circuits may be included in such computer systems to generate and monitor varying power supply voltage levels for the different circuit blocks.

Power management circuits often include one or more voltage regulator circuits configured to generate regulated voltage levels on respective power supply signals using a voltage level of an input power supply signal. Such regulator circuits may employ multiple passive circuit elements, such as inductors, capacitors, and the like.

SUMMARY OF THE EMBODIMENTS

Various embodiments for generating a regulated power supply voltage level are disclosed. Broadly speaking, a switch device that is coupled between an input power supply node and a regulated supply node may be configured to change, using a voltage level of a control node, a value of a supply current flowing from the input power supply node to the regulated supply node. A control circuit may be configured to generate a feedback signal using a voltage level of the regulated power supply node, and perform a comparison of a voltage level of the feedback signal to a reference voltage level. The control circuit may be further configured to adjust a voltage level of the control node using results of the comparison, and inject a noise cancelation current into the control node, where a value of the noise cancelation current is based on noise present on the input power supply node. In other embodiments, to perform the comparison, the control circuit is further configured to amplify a difference between the voltage level of the feedback signal and the reference voltage level, and adjust the voltage level of the control to a value proportional to the difference between the voltage level of the feedback signal and the reference voltage level.

BRIEF DESCRIPTION OF THE DRAWINGS

The following detailed description makes reference to the accompanying drawings, which are now briefly described.

Figure 1:
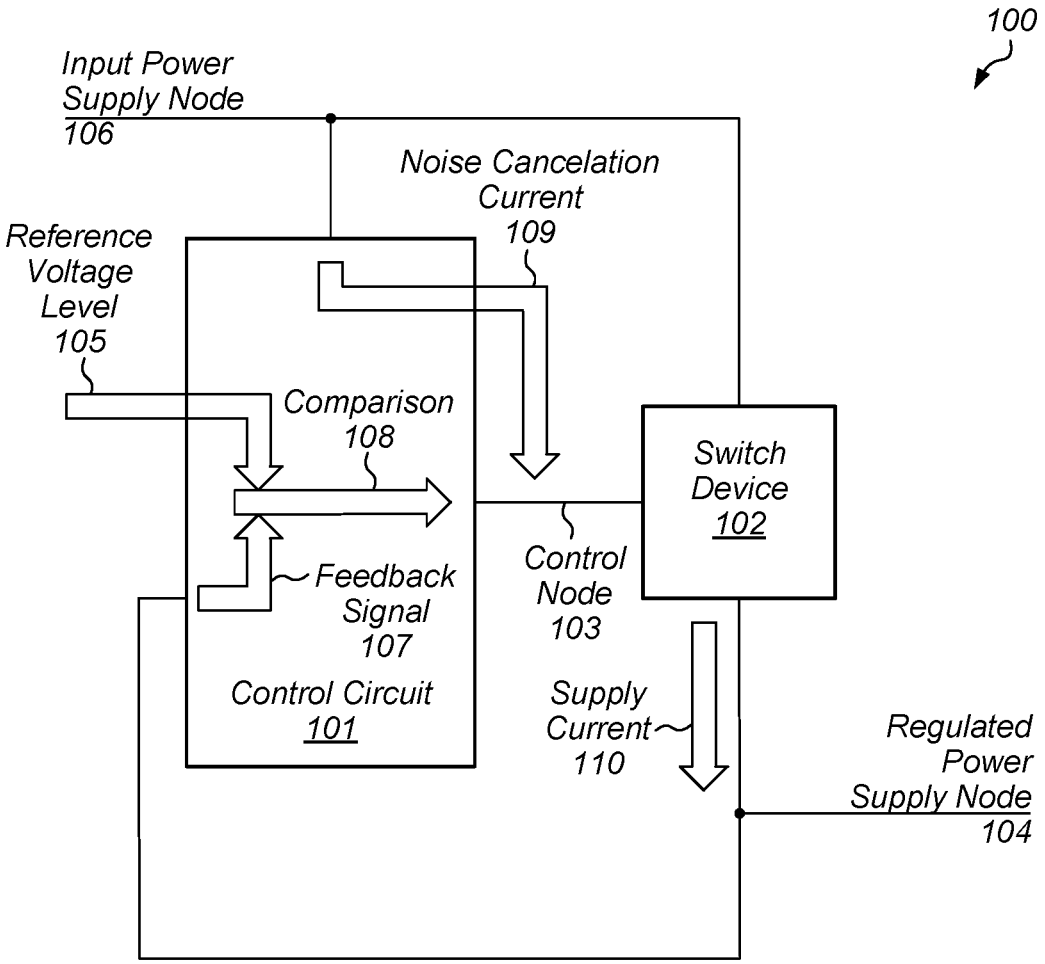
FIG. 1 is a block diagram of an embodiment of a voltage regulator circuit.

While the disclosure is susceptible to various modifications and alternative forms, specific embodiments thereof are shown by way of example in the drawings and will herein be described in detail. It should be understood, however, that the drawings and detailed description thereto are not intended to limit the disclosure to the particular form illustrated, but on the contrary, the intention is to cover all modifications, equivalents and alternatives falling within the spirit and scope of the present disclosure as defined by the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include," "including," and "includes" mean including, but not limited to.

Various units, circuits, or other components may be described as "configured to" perform a task or tasks. In such contexts, "configured to" is a broad recitation of structure generally meaning "having circuitry that" performs the task or tasks during operation. As such, the unit/circuit/component can be configured to perform the task even when the unit/circuit/component is not currently on. In general, the circuitry that forms the structure corresponding to "configured to" may include hardware circuits. Similarly, various units/circuits/components may be described as performing a task or tasks, for convenience in the description. Such descriptions should be interpreted as including the phrase "configured to." Reciting a unit/circuit/component that is configured to perform one or more tasks is expressly intended not to invoke 35 U.S.C. § 112, paragraph (f) interpretation for that unit/circuit/component. More generally, the recitation of any element is expressly intended not to invoke 35 U.S.C. § 112, paragraph (f) interpretation for that element unless the language "means for" or "step for" is specifically recited.

As used herein, the term "based on" is used to describe one or more factors that affect a determination. This term does not foreclose the possibility that additional factors may affect the determination. That is, a determination may be solely based on specified factors or based on the specified factors as well as other, unspecified factors. Consider the phrase "determine A based on B." This phrase specifies that B is a factor that is used to determine A or that affects the determination of A. This phrase does not foreclose that the determination of A may also be based on some other factor, such as C. This phrase is also intended to cover an embodiment in which A is determined based solely on B. The phrase "based on" is thus synonymous with the phrase "based at least in part on."

DETAILED DESCRIPTION OF EMBODIMENTS

Computer systems may include multiple circuit blocks configured to perform specific functions. Such circuit blocks may be fabricated on a common substrate and may employ different power supply voltage levels. Power management units (commonly referred to as "PMUs") may include multiple voltage regulator circuits configured to generate regulated voltage levels for various power supply signals. Such voltage regulator circuits may employ regulator circuits that include both passive circuit elements (e.g., inductors, capacitors, etc.) as well as active circuit elements (e.g., transistors, diodes, etc.).

Different types of voltage regulator circuits may be employed based on power requirements of load circuits, available circuit area, and the like. One type of commonly used voltage regulator circuit is a low drop-out regulator circuit. Such regulator circuits include one or more devices coupled between an input power supply node and regulated supply node. Based on a comparison of a reference signal to feedback signal generated from the regulated supply node, the conduction of the one or more devices is adjusted to achieve a desired voltage level on the regulated supply node.

Compared to switching power converters (e.g., buck regulators), low drop-out regulator circuits employ less passive circuit elements. Low drop-out regulator circuits are, therefore, often employed in computer systems where circuit size is a limiting factor. Moreover, low drop-out regulator circuits may also exhibit less noise than their switching counterparts, making them better suited to low noise applications. The performance of some circuits, however, may still be adversely affected by the noise on a regulated supply node of a low drop-out regulator. For example, power supply noise can result a clock generator circuit producing a clock signal with an unacceptable amount of jitter.

As used and described herein power supply noise (or simply "noise") present on a power supply node refers a time-varying (or alternating current (AC)) variation of the voltage level of the power supply from a desired direct current (DC) value for the voltage level. Noise on a power supply node can result from capacitive coupling of time-varying signals into the power node resulting in variation of the voltage level of the power supply node from its desired level. In some cases, the variation of the voltage level of the power supply can be tens to hundreds of millivolts, and may a have frequency anywhere from a few megahertz to a few gigahertz.

As will be described in detail below, employing a feedforward noise cancelation current whose value is based on noise present on an input power supply node, the power supply rejection of a low drop-out regulator circuit may be improved, while providing desired transient and regulation characteristics, and achieving a desired circuit area, low power consumption, and a low drop-out voltage.

A block diagram depicting an embodiment of a voltage regulator circuit is depicted in FIG. 1. As illustrated, voltage regulator circuit 100 includes control circuit 101 and switch device 102.

Switch device 102 is coupled between input power supply node 106 and regulated power supply node 104, and is configured to change, using a voltage level of control node 103, a value of supply current 110 flowing from input power supply node 106 to regulated power supply node 104. As described below in more detail, switch device 102 may include multiple transconductance devices whose conduction is based, at least in part, on a voltage level of control node 103.

Control circuit 101 is configured to generate feedback signal 107 using a voltage level of regulated power supply node 104, and perform a comparison of a voltage level of feedback signal 107 to reference voltage level 105 to generate comparison 108. Control circuit 101 is further configured to adjust the voltage level of control node 103 using comparison 108. By adjusting the voltage level of control node 103 in such a fashion, the voltage level of regulated power supply node 104 may be maintained a desired level.

Noise present on input power supply node 106 may couple via switch device 102 onto regulated power supply node 104. As noted above, such noise may result in circuits that draw their power from regulated power supply node 104 to function in a non-ideal fashion. To remediate the effects of the noise present on input power supply node 106 coupling into regulated power supply node 104, control circuit 101 is further configured to inject noise cancelation current 109 into control node 103. In various embodiments, a value of noise cancelation current 109 is based, at least in part, on the noise present on input power supply node 106. By injecting the noise cancelation current 109, the power supply rejection (PSR) of voltage regulator circuit 100 may be improved by reducing an amount of the noise present on input power supply node 106 that appears on regulated power supply node 104.

Figure 2:
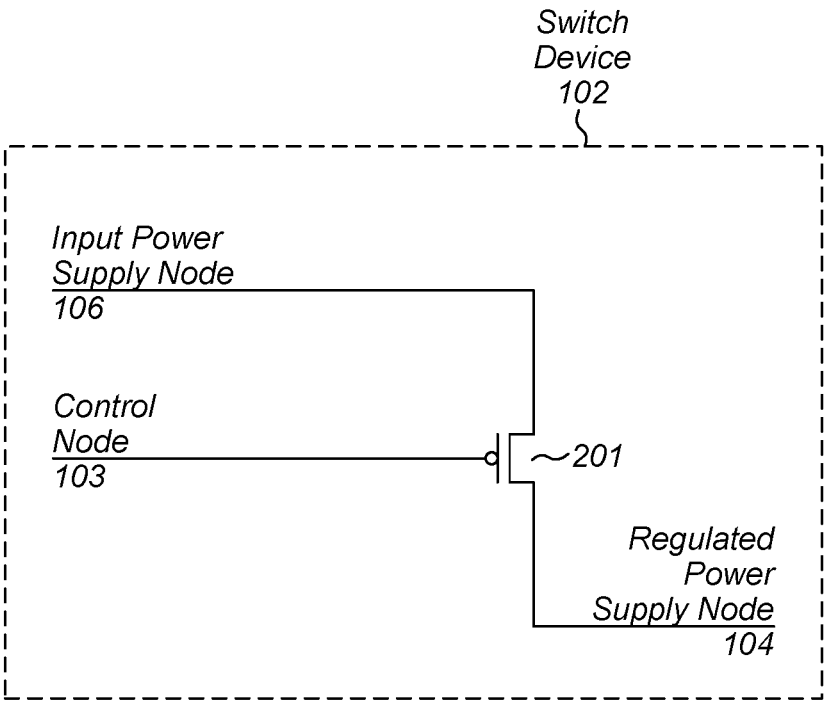
FIG. 2 is a block diagram of an embodiment of a switch device.

Turning to FIG. 2, a block diagram of an embodiment of switch device 102 is depicted. As illustrated, switch device 102 includes device 201 that is coupled between input power supply node 106 and regulated power supply node 104. A control terminal of device 201 is coupled to control node 103. It is noted that although only a single device is depicted in the embodiment of FIG. 2, in other embodiments, multiple devices may be connected in parallel between input power supply node 106, regulated power supply node 104, and control node 103.

Device 201 may, in various cases, be a particular embodiment of a p-channel metal-oxide semiconductor field-effect transistor (MOSFET), or other suitable transconductance device. In various embodiments, device 201 is configured to modify an impedance between input power supply node 106 and regulated power supply node 104 based, at least in part, on a voltage level of control node 103, thereby adjusting a value of supply current 110. In general, the lower the voltage level of control node 103, the lower the value of the impedance between input power supply node 106 and regulated power supply node 104, and the higher the value of supply current 110.

Figure 3:
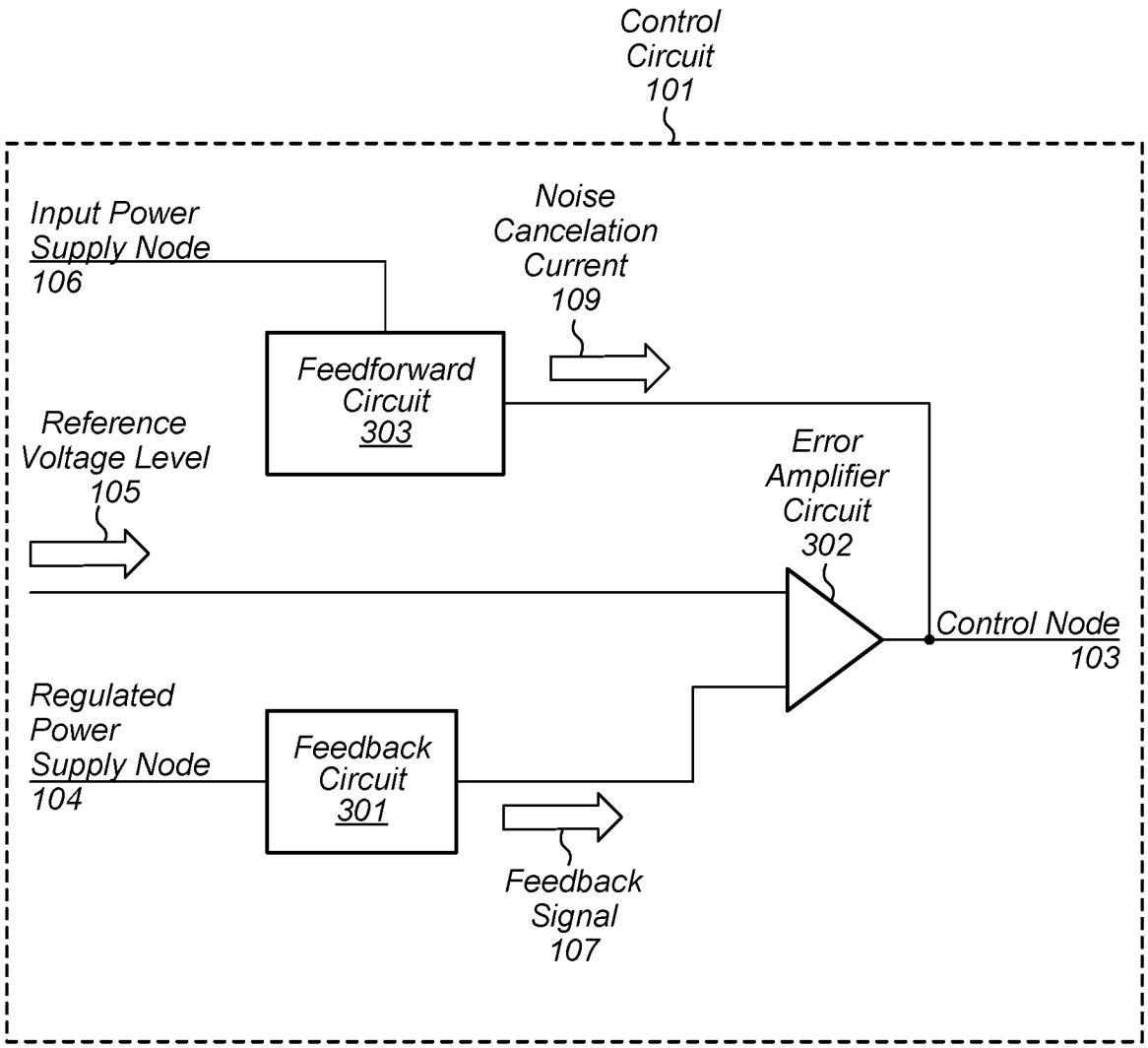
FIG. 3 is a block diagram of a control circuit used in a voltage regulator circuit.

An embodiment of control circuit 101 is depicted in the block diagram of FIG. 3. As illustrated, control circuit 101 includes feedback circuit 301, error amplifier circuit 302, and feedforward circuit 303.

As described below in more detail, feedback circuit 301 is configured to generate feedback signal 107 using a voltage level of regulated power supply node 104. In various embodiments, feedback circuit 301 may be configured to generate feedback signal 107 such that a voltage level of feedback signal 107 may be proportional to the voltage level of regulated power supply node 104. For example, in some cases, the voltage level of feedback signal 107 may be substantially the same of the voltage level of regulated power supply node 104, while in other cases, the voltage level of feedback signal 107 may be a fractional value of the voltage level of regulated power supply node 104. As used herein, the term "substantially the same" refers to a case where two values are within a threshold value of each other.

Error amplifier circuit 302 may be a particular embodiment of a differential amplifier circuit configured to compare reference voltage level 105 and a voltage level of feedback signal 107. In various embodiments, error amplifier circuit 302 may be further configured to adjust a voltage level of control node 103 using results of the comparison of reference voltage level 105 and the voltage level of feedback signal 107. Error amplifier circuit 302 may, in some embodiments, generate a voltage level on control node 103 that is proportional to a difference between reference voltage level 105 and the voltage level of feedback signal 107.

As described below in more detail, feedforward circuit 303 is configured to generate, using input power supply node 106, noise cancelation current 109, and inject noise cancelation current 109 into control node 103. In various embodiments, feedforward circuit 303 may be further configured to generate noise cancelation current 109 such that a value of noise cancelation current 109 is based, at least in part, on noise present on input power supply node 106. For example, the greater an amount noise that is present on input power supply node 106, the greater the value of noise cancelation current 109.

Figure 4:
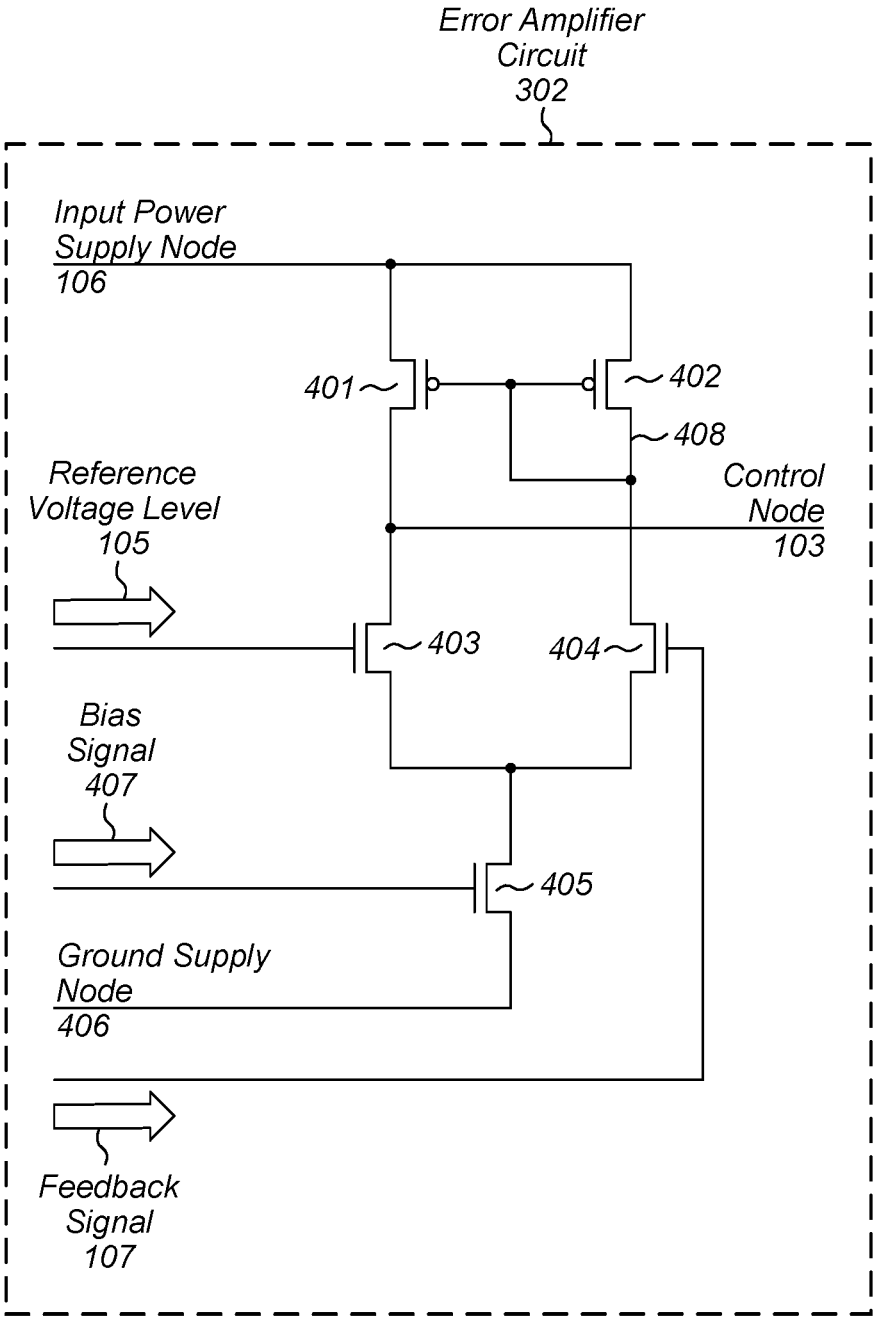
FIG. 4 is a block diagram of an embodiment of an error amplifier circuit.

Turning to FIG. 4, an embodiment of error amplifier circuit 302 is depicted. As illustrated, error amplifier circuit 302 includes devices 401-405. Devices 401 and 402 may be particular embodiments of p-channel MOSFETs, while devices 403-405 may be particular embodiments of n-channel MOSFETs.

Devices 401 is coupled between input power supply node 106 and control node 103, while device 402 is coupled between input power supply node 106 and node 408. Respective control terminals of devices 401 and 402 are coupled to node 408. It is noted that devices 401 and 402 are arranged as a current mirror circuit that maintains a relationship between respective currents flowing through devices 403 and 404. In some cases, the electrical characteristics of the devices 401 and 402 may be selected such that the respective currents flowing through devices 403 and 404 are substantially the same.

Devices 403 and 404 for a differential pair, and typically have similar electrical characteristics. Devices 403 is coupled between control node 103 and device 405, while device 404 is coupled between node 408 and device 405. Device 403 is controlled by reference voltage level 105, while device 404 is controlled by feedback signal 107. Device 405 is coupled between devices 403 and 404, and ground supply node 406, and is controlled by bias signal 407. In various embodiments, bias signal 407 may be generated internal or external to voltage regulator circuit 100 and may be based, at least in part, on the voltage level of input power supply node 106, a temperature of voltage regulator circuit 100, or any suitable physical or electrical characteristic associated with voltage regulator circuit 100.

A voltage level of bias signal 407 sets an operating point for devices 403 and 404 by sinking a current from the sources of devices 403 and 404. Since the currents flowing through devices 403 and 404 must be substantially the same due to the current mirror circuit formed by devices 401 and 402, any difference between reference voltage level 105 and the voltage level of feedback signal 107 will result in a difference between the respective voltage levels of node 408 and control node 103. For example, when the voltage level of feedback signal 107 is less than reference voltage level 105, the voltage level of control node 103 will decrease, while the voltage level of node 408 will increase.

It is noted that the embodiment of error amplifier circuit 302 depicted in FIG. 4 is merely an example. In other embodiments, different amplifier circuit topologies may be employed to compare the voltage level of feedback signal 107 and reference voltage level 105.

Figure 5:
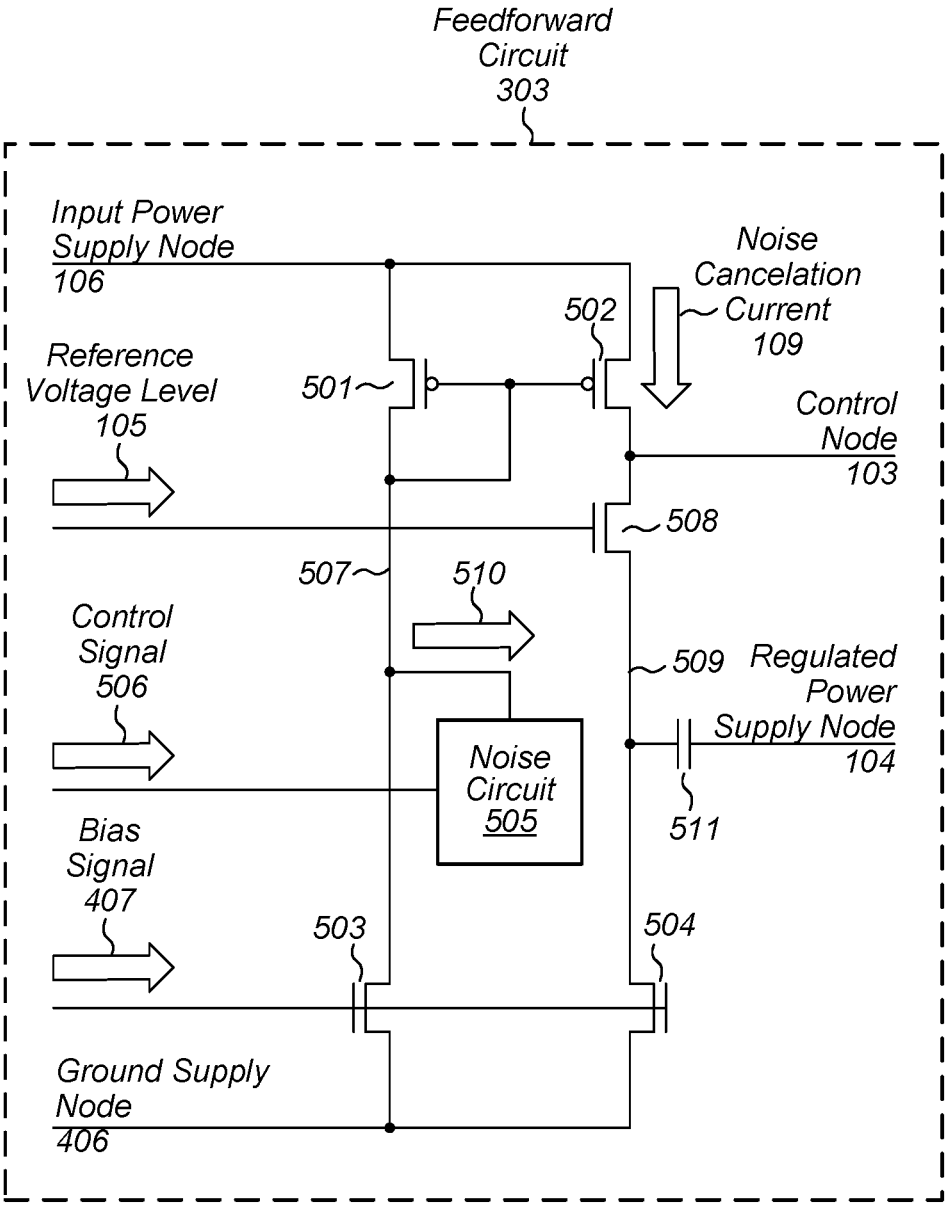
FIG. 5 is a block diagram of an embodiment of a feedforward circuit.

An embodiment of feedforward circuit 303 is depicted in FIG. 5. As illustrated, feedforward circuit 303 includes devices 501-504, device 508, capacitor 511, and noise circuit 505. In various embodiments, devices 501 and 502 may be particular embodiments of p-channel MOSFETs, while devices 503, 504, and 508 may be particular embodiments of n-channel MOSFETs.

Device 501 is coupled between input power supply node 106 and node 507, and device 502 is coupled between input power supply node 106 and control node 103. Respective control terminals of devices 501 and 502 are coupled to node 507. Since the control terminal of device 501 is coupled to its drain terminal, device 501 is referred to as being "diode connected." It is noted that devices 501 and 502 are arranged to form a current mirror circuit that mirrors current flowing through node 507 into a current sourced to control node 103 to adjust the voltage level of control node 103. Device 508 is coupled between control node 103 and node 509 and is controlled by reference voltage level 105. Based, at least in part, on reference voltage level 105, device 508 provides a buffered path for capacitor 511 to provide feedback to control node 103. Node 509 is coupled to regulated power supply node 104 via capacitor 511. In various embodiments, capacitor 511 may be a particular embodiment of a metal-oxide-metal (MOM) capacitor or other suitable capacitor structure.

Device 503 is coupled between node 507 and ground supply node 406, while device 504 is coupled between node 509 and ground supply node 406. Both device 503 and device 504 are controlled by bias signal 407 to establish operating point currents flowing through nodes 507 and 509.

Noise circuit 505 is configured to generate initial noise current 510 whose value is based, at least in part, on noise present on input power supply node 106. As described below in more detail, noise circuit 505 includes at least one capacitor, and noise present on input power supply node 106 appears on a terminal of the at least one capacitor due to its connection to input power supply node 106 via diode-connected device 501. The noise on input power supply node 106 creates initial noise current 510, which is an alternating current (AC) current proportional to the noise present on input power supply node 106 that is superimposed on a direct current (DC) current flowing through node 507. Initial noise current 510 is mirrored through devices 501 and 502, in order to inject noise cancelation current 109 into control node 103.

In order to cancel the noise present on input power supply node 106, the value of the capacitor included in noise circuit 505 is selected to match the gate-to-drain capacitance of switch device 102. As used herein, to match the gate-to-drain capacitance of switch device 102 refers to a situation wherein a value of the capacitor included in noise circuit 505 is within a threshold value of the gate-to-drain capacitance of switch device 102. With such a value for the capacitor included in noise circuit 505, the value of noise cancelation current 109 is given by Equation 1, where $C_{gd_switch}$ is the gate-to-drain capacitance of switch device 102 and $V_{ips}$ is the voltage level of input power supply node 106.

$$I_{noise}(s)=sC_{gd_switch}V_{ips} \quad (1)$$

Figure 6:
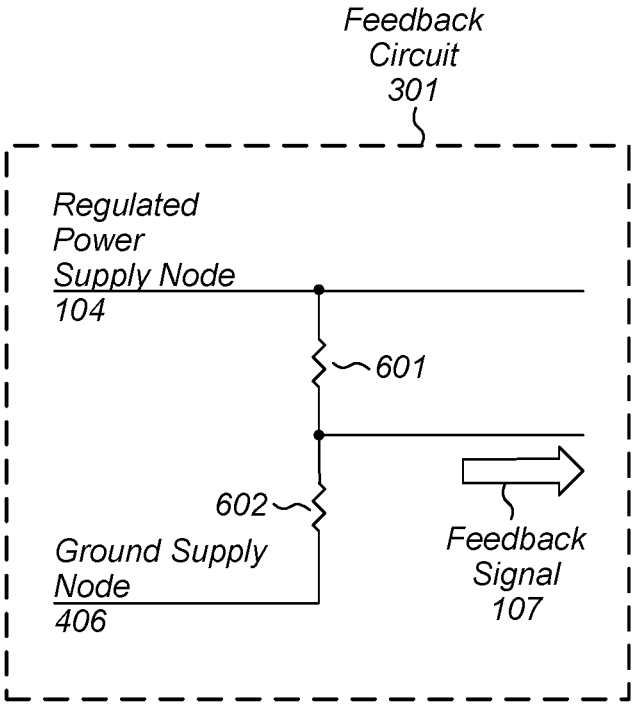
FIG. 6 is a block diagram of an embodiment of a feedback circuit.

Turning to FIG. 6, an embodiment of feedback circuit 301 is depicted. As illustrated, feedback circuit 301 includes resistors 601 and 602, which are coupled, in series, between regulated power supply node 104 and ground supply node 406, to form a resistive voltage divider circuit. Although only two resistors are depicted in the embodiment of FIG. 6, in other embodiments, additional resistors may be employed. For example, resistor 601 may include multiple resistors coupled in parallel.

The series connect of resistors 601 and 602 results in a current the flows from regulated power supply node 104 to ground supply node 406 through resistors 601 and 602. The value of the current is determined by a voltage level of regulated power supply node 104 and respective values of resistors 601 and 602. In various embodiments, the voltage drop developed across resistor 602 corresponds to the voltage level of feedback signal 107, the value of which can be determined using Equation 2, where $V_{fb}$ is the voltage level of feedback signal 107, $V_{rps}$ is the voltage level of regulated power supply node 104, $R_{601}$ is the value of resistor 601, and $R_{602}$ is the value of resistor 602. By adjusting the values of resistors 601 and 602, the voltage level of feedback signal 107 may be modified.

$$V_{fb} = V_{rps}\frac{R_{602}}{R_{601} + R_{602}} \tag{2}$$

Resistors 601 and 602 may be fabricated using metal, polysilicon, or any other suitable material available on a semiconductor manufacturing process used to fabricate voltage regulator circuit 100. It is noted that in some embodiments, resistors 601 and 602 may be located on a different integrated circuit than the remaining circuit blocks of voltage regulator circuit 100.

Noise circuit 505 can employ a variety of techniques for generating a noise current based on noise present on input power supply node 106. In general, noise circuit 505 may employ an adjustable capacitor that is coupled to node 507 of feedforward circuit 303. As noted above, the value of such a capacitor may be adjusted to match a gate-to-drain capacitance of switch device 102, or any other suitable criteria. Various circuit elements and techniques may be employed to realize the adjustable capacitor.

Figure 7:
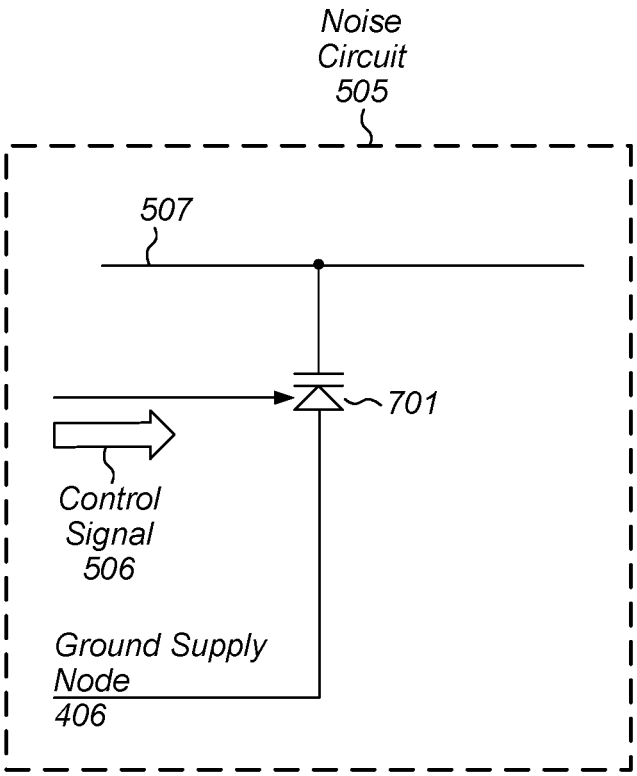
FIG. 7 is a block diagram of a particular embodiment of a feedforward generator circuit.

Turning to FIG. 7, an embodiment of noise circuit 505 is depicted. As illustrated, noise circuit 505 includes varactor 701 coupled between node 507 and ground supply node 406. Varactor 701 may be a particular embodiment of a varicap diode whose capacitance is based, at least in part, on a thickness of a depletion layer between n-type and p-type silicon layers. The thickness of the depletion layer may be controlled by the voltage level of control signal 506. In general, the lower the voltage level of control signal 506, the thinner the depletion region and the higher the capacitance between node 507 and ground supply node 406.

The voltage level of control signal 506 may be based, at least in part, on electrical characteristics of other circuit elements within voltage regulator circuit 100, as well as an amount of noise present on input power supply node 106. In various embodiments, control signal 506 may be generated within voltage regulator circuit 100 using any suitable combination of voltage bias and reference circuits, and the like. It is noted that in some cases, control signal may be generated external to voltage regulator circuit 100.

Figure 8:
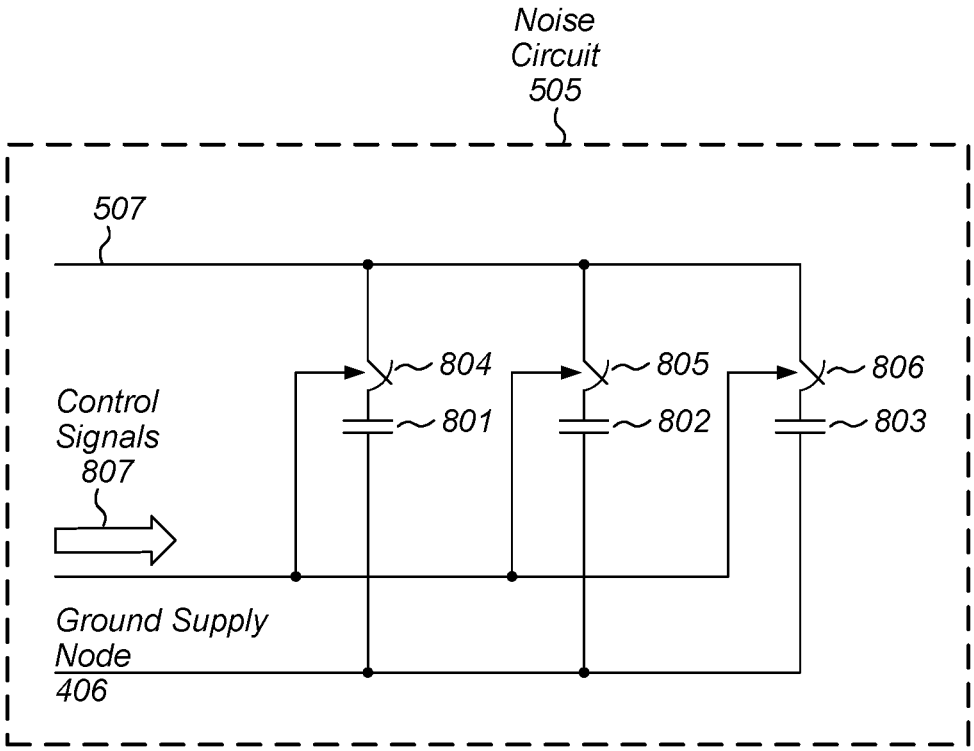
FIG. 8 is a block diagram of a different embodiment of a feedforward generator circuit.

Another embodiment of noise circuit 505 is depicted in FIG. 8. As illustrated, noise circuit 505 includes capacitors 801-803 and switches 804-806. Switches 804-806 are coupled to node 507 and to respective ones of capacitors 801-803, which are further coupled to ground supply node 406. Switches 804-806 are controlled by control signals 807. Although only three capacitors and three switches are depicted in FIG. 8, in other embodiments, any suitable number of capacitors and switches may be employed.

Switches 804-806 may be particular embodiments of pass gate circuits, which include any suitable combination of n-channel and p-channel MOSFETs. When a given one of switches 804-806 are closed, a corresponding one of capacitors 801-803 is coupled to node 507, thereby increasing the capacitance of between node 507 and ground supply node 406. In various embodiments, capacitors 801-803 may be particular embodiments of metal-oxide-metal (MOM) capacitors or any other suitable capacitor structure available in a semiconductor manufacturing process used to fabricate voltage regulator circuit 100.

Control signals 807 may include any suitable number of signals to operate switches 804-806. In various embodiments, control signals 807 may be digital signals generated within voltage regulator circuit 100. Alternatively, in other embodiments, control signals 807 may be generated external to voltage regulator circuit 100. In some cases, default values for control signals 807 may be factory set based on test results of voltage regulator circuit 100.

Figure 9:
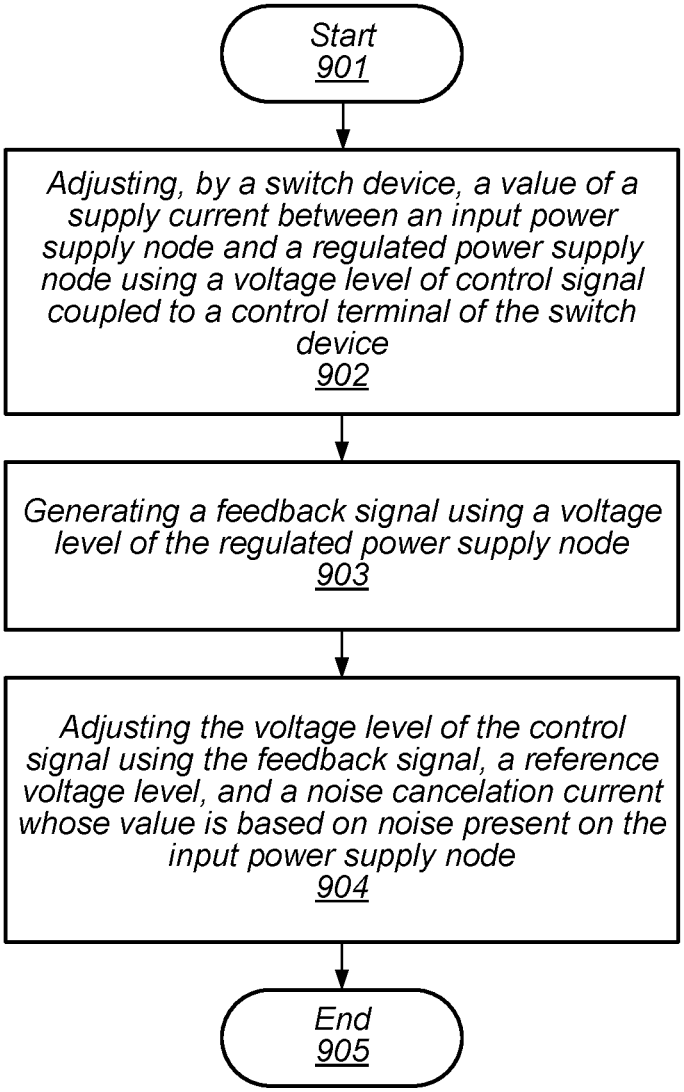
FIG. 9 illustrates a flow diagram depicting an embodiment of a method for operating a voltage regulator circuit.

A flow diagram depicting an embodiment of a method for operating a voltage regulator circuit is illustrated in FIG. 9. The method, which begins in block 901, may be applied to various voltage regulator circuits, including voltage regulator circuit 100 as illustrated in FIG. 1.

The method includes adjusting, by a switch device, a value of a supply current between an input power supply node and a regulated power supply node using a voltage level of a control signal coupled to a control terminal of the switch device (block 902).

The method further includes generating a feedback signal using a voltage level of the regulated power supply node (block 903). In some embodiments, generating the feedback signal using the voltage level of the regulated power supply node includes generating a current using a plurality of resistors coupled, in series, between the regulated power supply node and a ground supply node, and determining a voltage level of the feedback signal using the current and a particular one of the plurality of resistors.

The method also includes adjusting the voltage level of the control signal using the feedback signal, a reference voltage level and a noise cancelation current whose value is based on noise present on the input power supply node (block 904). In some embodiments, adjusting the voltage level of the control signal includes modifying the voltage level of the control signal using a result of comparing the voltage level of the feedback signal and the reference signal. In other embodiments, adjusting the voltage level of the control signal includes coupling the regulated power supply node to the control node using a capacitor.

Adjusting the voltage level of the control signal may, in various embodiments, also include coupling, a diode-connected device included in a current mirror, a capacitor to the input power supply node, generating the noise cancelation current using the capacitor, and mirror the noise cancelation current into the control terminal of the switch device. In some embodiments, coupling the capacitor includes selecting, using a plurality of selection signals, one or more capacitors of plurality of capacitors, while in other embodiments, coupling the capacitor includes adjusting a value of capacitance between the diode-connected device and a ground supply node using a varactor and an adjustment signal. The method concludes in block 905.

Figure 10:
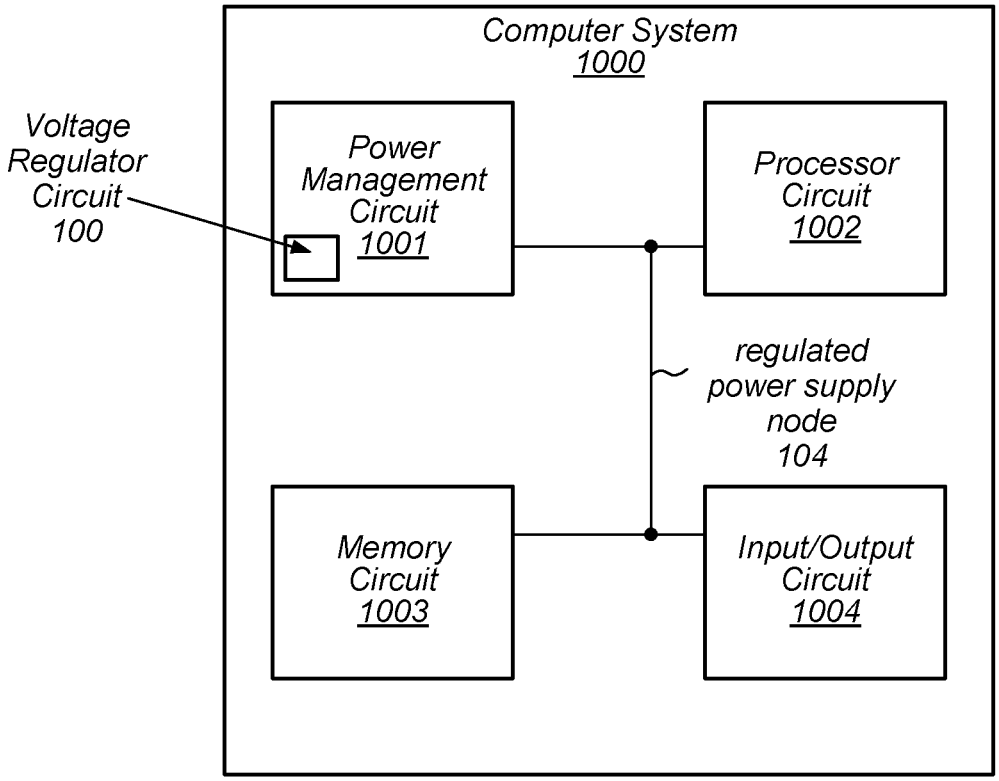
FIG. 10 is a block diagram of a computer system.

A block diagram of computer system is illustrated in FIG. 10. In the illustrated embodiment, the computer system 1000 includes power management unit 1001, processor circuit 1002, memory circuit 1003, and input/output circuits 1004, each of which is coupled to regulated power supply node 104. It is noted that processor circuit 1002, memory circuit 1003, and input/output circuits 1004 may be collectively referred to as "load circuits" for power management unit 1001. In various embodiments, computer system 1000 may be a system-on-a-chip (SoC) and/or be configured for use in a desktop computer, server, or in a mobile computing application such as, e.g., a tablet, laptop computer, or wearable computing device.

Power management unit 1001 includes voltage regulator circuit 100, which is configured to generate a regulated voltage level on regulated power supply node 104 in order to provide power to processor circuit 1002, memory circuit 1003, and input/output circuits 1004. Although power management unit 1001 is depicted as including a single power converter circuit, in other embodiments, any suitable number of power converter circuits may be included in power management unit 1001, each configured to generate a regulated voltage level on a respective one of multiple internal power supply signals included in computer system 1000. In cases where multiple power converter circuits are employed, two or more of the multiple power converter circuits may be connected to a common set of power terminals that connects to power supply signals and ground supply signals of computer system 1000.

Processor circuit 1002 may, in various embodiments, be representative of a general-purpose processor that performs computational operations. For example, processor circuit 1002 may be a central processing unit (CPU) such as a microprocessor, a microcontroller, an application-specific integrated circuit (ASIC), or a field-programmable gate array (FPGA).

Memory circuit 1003 may in various embodiments, include any suitable type of memory such as a Dynamic Random-Access Memory (DRAM), a Static Random-Access Memory (SRAM), a Read-Only Memory (ROM), Electrically Erasable Programmable Read-only Memory (EEPROM), or a non-volatile memory, for example. It is noted that although in a single memory circuit is illustrated in FIG. 10, in other embodiments, any suitable number of memory circuits may be employed.

Input/output circuits 1004 may be configured to coordinate data transfer between computer system 1000 and one or more peripheral devices. Such peripheral devices may include, without limitation, storage devices (e.g., magnetic or optical media-based storage devices including hard drives, tape drives, CD drives, DVD drives, etc.), audio processing subsystems, or any other suitable type of peripheral devices. In some embodiments, input/output circuits 1004 may be configured to implement a version of Universal Serial Bus (USB) protocol or IEEE 1394 (Firewire®) protocol.

Input/output circuits 1004 may also be configured to coordinate data transfer between computer system 1000 and one or more devices (e.g., other computing systems or integrated circuits) coupled to computer system 1000 via a network. In one embodiment, input/output circuits 1004 may be configured to perform the data processing necessary to implement an Ethernet (IEEE 802.3) networking standard such as Gigabit Ethernet or 10-Gigabit Ethernet, for example, although it is contemplated that any suitable networking standard may be implemented. In some embodiments, input/output circuits 1004 may be configured to implement multiple discrete network interface ports.

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

What is claimed is:

1. An apparatus, comprising:

a switch device coupled between an input power supply node and a regulated power supply node, wherein the switch device is configured to change, using a voltage level of a control node, a value of a supply current flowing from the input power supply node to the regulated power supply node; and a control circuit including a current mirror circuit that includes a capacitor and a diode-connected device, wherein the capacitor is coupled to the input power supply node via the diode-connected device, wherein the control circuit is configured to:

generate an initial noise current using the capacitor, wherein a value of the initial noise current is based on noise present on the input power supply node;

generate a feedback signal using a voltage level of the regulated power supply node;

perform a comparison of a voltage level of the feedback signal and a reference voltage level; and adjust, using results of the comparison, the voltage level of the control node; and wherein the current mirror circuit is configured to mirror the initial noise current to inject a noise cancelation current into the control node, wherein a value of the noise cancelation current is based on noise present on the input power supply node.

2. The apparatus of claim 1, wherein to compare the voltage level of the feedback signal to the reference voltage level, the control circuit is further configured to:

amplify a difference between the voltage level of the feedback signal and the reference voltage level; and modify the voltage level of the control node using an amplified version of the difference between the voltage level of the feedback signal and the reference voltage level.

3. The apparatus of claim 1, wherein the capacitor includes a plurality of capacitors, and wherein the current mirror circuit is further configured to selectively couple one or more of the capacitors to the diode-connected device using a plurality of selection signals.

4. The apparatus of claim 1, wherein the capacitor includes a varactor configured, based on a voltage level of an adjustment signal, to change a value of the capacitor between a terminal of the diode-connected device and a ground supply node.

5. The apparatus of claim 1, wherein the control circuit includes a resistor divider circuit configured to generate the feedback signal using the voltage level of the regulated power supply node and a plurality of resistors.

6. A method, comprising:

adjusting, by a switch device, a value of a supply current between an input power supply node and a regulated power supply node using a voltage level of a control signal coupled to a control terminal of the switch device;

generating a feedback signal using a voltage level of the regulated power supply node;

coupling, via a diode-connected device included in a current mirror, a capacitor to the input power supply node;

generating a noise cancelation current by the capacitor;

mirroring the noise cancelation current into the control terminal of the switch device, wherein a value of the noise cancelation current is based on noise present on the input power supply node; and adjusting the voltage level of the control signal using the feedback signal, a reference voltage level, and the noise cancelation current.

7. The method of claim 6, wherein adjusting the voltage level of the control signal includes modifying the voltage level of the control signal using results of comparing the voltage level of the feedback signal and the reference voltage level.

8. The method of claim 6, wherein adjusting the voltage level of the control signal includes coupling the regulated power supply node to the control terminal using a capacitor.

9. The method of claim 6, wherein coupling the capacitor includes selecting, using a plurality of selection signals, one or more capacitors of a plurality of capacitors.

10. The method of claim 6, wherein coupling the capacitor includes adjusting a value of capacitance between the diode-connected device and a ground supply node using a varactor and an adjustment signal.

11. The method of claim 6, wherein generating the feedback signal includes:

generating a current using a plurality of resistors coupled, in series, between the regulated power supply node and a ground supply node; and determining a voltage level of the feedback signal using the current and a particular one of the plurality of resistors.

12. An apparatus, comprising:

a load circuit coupled to a regulated power supply node; and a voltage regulator circuit including a current mirror circuit that includes a capacitor and a diode-connected device, wherein the capacitor is coupled to an input power supply node via the diode-connected device, wherein the voltage regulator circuit is configured to:

generate an initial noise current using the capacitor;

adjust a value of a supply current between the input power supply node and the regulated power supply node using a voltage level of a control node coupled to a switch device that is coupled between the input power supply node and the regulated power supply node; and generate a feedback signal using a voltage level of the regulated power supply node; and wherein the current mirror circuit is configured to mirror the initial noise current to source a noise cancelation current to the control node, wherein a value of the noise cancelation current is based on noise included on the input power supply node; and wherein the voltage regulator circuit is further configured to modify the voltage level of the control node using the feedback signal, a reference voltage level, and the noise cancelation current.

13. The apparatus of claim 12, wherein to adjust the voltage level of the control node, the voltage regulator circuit is further configured to modify, using results of a comparison of the voltage level of the feedback signal and the reference voltage level, the voltage level of the control node.

14. The apparatus of claim 12, wherein to adjust the voltage level of the control node, the voltage regulator circuit is further configured to couple the regulated power supply node to the control node using a capacitor.

15. The apparatus of claim 12, wherein the voltage regulator circuit is further configured to select one or more capacitors of a plurality of capacitors to couple to the diode-connected device.

16. The apparatus of claim 12, wherein the capacitor includes a varactor, and wherein the voltage regulator circuit is further configured to adjust a value of capacitance between the diode-connected device and a ground supply node using an adjustment signal coupled to the varactor.

17. The apparatus of claim 12, wherein the voltage regulator circuit includes a voltage divider circuit, including a plurality of resistors coupled, in series, between the regulated power supply node and a ground supply node, and wherein the voltage regulator circuit is configured to determine a voltage level of the feedback signal.

* * * * *